US007048353B2

(12) United States Patent
Waller et al.

(10) Patent No.: US 7,048,353 B2
(45) Date of Patent: May 23, 2006

(54) PRINTHEAD MAINTENANCE SYSTEM

(75) Inventors: David J. Waller, Vancouver, WA (US); Jeremy A. Davis, Battle Ground, WA (US); Kit L. Harper, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 578 days.

(21) Appl. No.: 10/278,545

(22) Filed: Oct. 22, 2002

(65) Prior Publication Data

US 2004/0075702 A1 Apr. 22, 2004

(51) Int. Cl.
*B41J 2/165* (2006.01)
*B41J 2/175* (2006.01)
*B41J 2/18* (2006.01)

(52) U.S. Cl. ..... 347/35; 347/85; 347/89

(58) Field of Classification Search ..... 347/22, 347/29, 30, 33, 35, 84, 85, 86, 89
See application file for complete search history.

(56) References Cited

U.S. PATENT DOCUMENTS 4,107,699 A 8/1978 Kenworthy
5,428,378 A 6/1995 Murata et al.
6,123,409 A 9/2000 Wolf
6,132,026 A 10/2000 Taylor et al.
6,145,958 A 11/2000 Medin et al.
6,158,838 A 12/2000 Capurso
6,213,583 B1 4/2001 Therien
6,224,186 B1 5/2001 Johnson et al.
6,234,620 B1 5/2001 Faisst, Jr. et al.
6,273,547 B1 8/2001 Aldrich
6,281,911 B1 8/2001 Nakazawa et al.
6,340,220 B1 1/2002 Gaylor et al.

FOREIGN PATENT DOCUMENTS

JP 59045163 3/1984
JP 59209876 11/1984
JP 406126983 A * 5/1994

* cited by examiner

*Primary Examiner*—Shih-Wen Hsieh

(57) ABSTRACT

A system for receiving and recycling ink comprises a print cartridge having a printhead, and an ink supply reservoir fluidly connected to the print cartridge and a seal member coupled to the ink supply reservoir. The seal member defines a fluid path into the reservoir and the print cartridge engages the seal member so that ink spit from the printhead flows through the fluid path into the reservoir.

34 Claims, 3 Drawing Sheets

PRINTHEAD MAINTENANCE SYSTEM

BACKGROUND OF THE INVENTION

Inkjet printheads require regular servicing in order to maintain the printheads and the quality of print jobs. Although there are many types of servicing systems and service stations, three pen service procedures involve wiping, spitting and capping. Wiping is a process by which the printhead nozzles are engaged with a scraper, typically rubber, to clean accumulated ink and debris off the nozzles. Spitting is a step that involves positioning the printheads over a waste ink receptacle—a spittoon—and causing the inkjet printhead to eject a volume of ink through the nozzles into the spittoon. Spittoons are simply receptacles that collect the waste ink. Sometimes spittoons are lined with absorbent material to retain the waste ink. Capping involves positioning the printheads in physical contact with a closely fitting cap—typically rubber or some other elastomer—to maintain a controlled atmosphere environment around the printheads during periods of inactivity.

Many inkjet printer service stations are configured for performing each of these three servicing tasks, and there are many variations in the order and frequency of the three servicing tasks. However, printhead servicing does not address issues relating to ink supply for the pen.

DETAILED DESCRIPTION OF PREFERRED EMBODIMENTS

Figure 1:
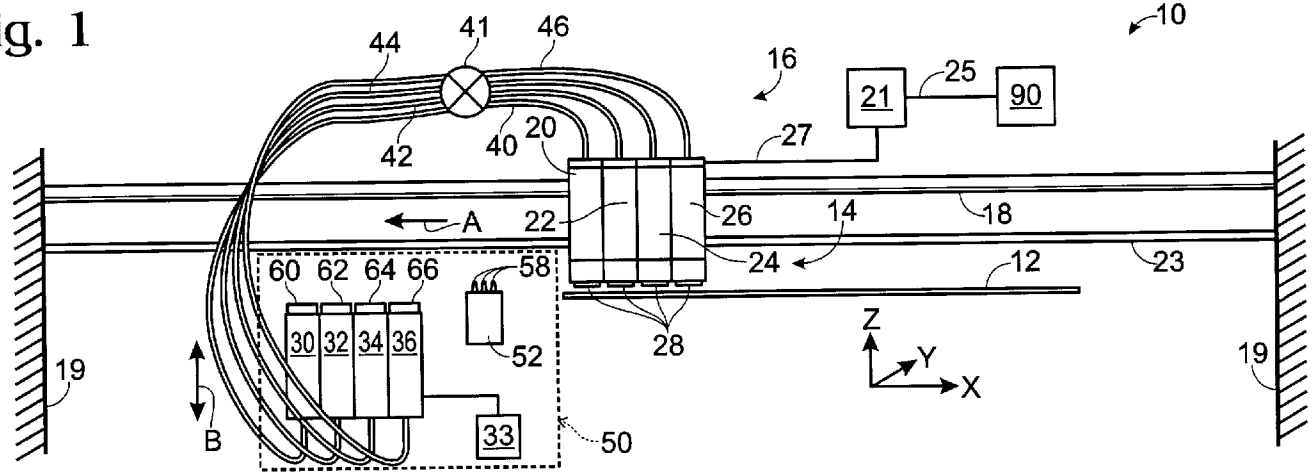
FIG. 1 is a schematic front view of selected components of an inkjet printer according to an embodiment of the present invention, illustrating the inkjet pens laterally adjacent the ink supply and with the pens positioned as they would be during printing operations.

Many hardcopy devices that rely upon inkjet printing technology include service stations for maintaining the quality of the printheads, and thus the quality of the print jobs. A schematic representation of an inkjet printer according to an illustrated embodiment of the present invention is shown in the drawings. It will be appreciated that like reference numerals are used throughout the specification to identify like structural features found in more than one drawing figure.

Figure 2:
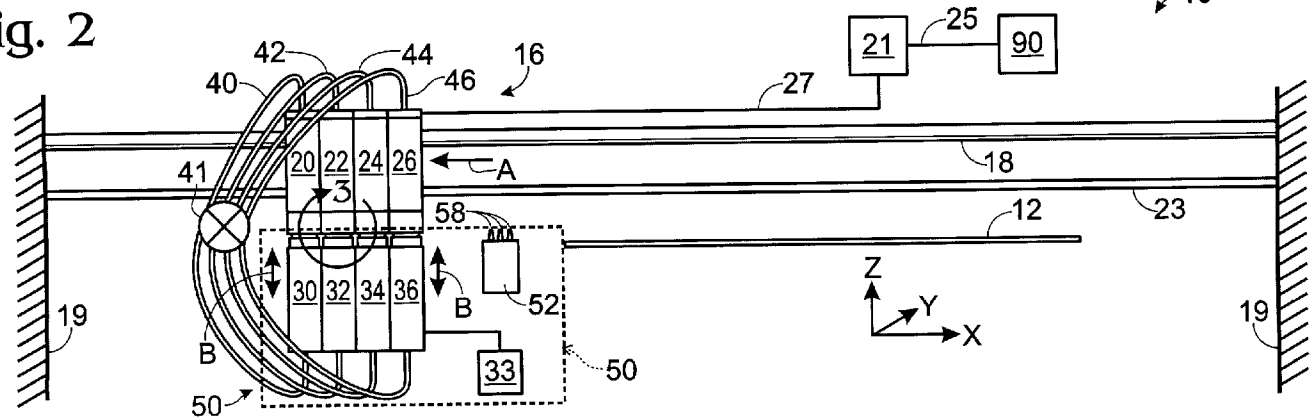
FIG. 2 is a schematic front view of the inkjet printer shown in FIG. 1 with the inkjet pens parked in the service station according to an embodiment of the present invention.

With reference to FIGS. 1 and 2, the inkjet printer 10 depicts in a highly schematic manner an inkjet hard copy apparatus, in this case, a color printer. It will be appreciated that printer 10 includes numerous electrical and mechanical operating mechanisms that are necessary to operation of the printer, but not needed to illustrate the components or invention described herein. As such, many electrical and mechanical operating mechanisms are omitted from the drawings for clarity. An internal electronic controller 90, which is usually a microprocessor or application specific integrated circuit ("ASIC") controlled printed circuit board, administrates operation of inkjet printer 10, which is connected by appropriate cabling to an external computer (not shown). It is well known to program and execute imaging, printing, print media handling, control functions, and logic with firmware or software instructions for conventional or general purpose microprocessors or ASICs. Print media 12 (referred to generically herein simply as "paper," regardless of actual medium selected by the end-user, for example, cut sheet or roll stock material such as paper, film, and the like) is loaded by the end-user onto an input tray (not shown). Sheets of paper are then sequentially fed by a suitable, internal, paper-path transport mechanism to a printing station that defines a printzone 14 where graphical images or alphanumeric text are created using color imaging and text rendering techniques. In FIG. 1, printzone 14 is defined generally as the area beneath the region traversed by the inkjet print cartridges 20, 22, 24 and 26 where ink is applied to the paper 12.

A carriage 16 mounted on a shaft 18 that has its opposite ends mounted to a printer chassis 19 to support in an operative position relative to paper 12 a set of four inkjet writing instruments, known as print cartridges, and labeled 20, 22, 24, and 26, respectively. Fewer print cartridges or more print cartridges may be used in different printers. As detailed below, each of the inkjet print cartridges 20 through 26 has at least one printhead 28 on the lower side of the print cartridges facing the printzone 14. Each printhead 28 is adapted for expelling minute droplets of ink or other fluids to form dots on adjacently positioned paper 12 in the print zone 14. Each printhead 28 generally consists of a drop generator mechanism and a number of columns of ink drop firing nozzles. Each column of nozzles, or a selected subset of nozzles, selectively fires ink droplets, each droplet typically being only a tiny liquid volume, that are used to create a predetermined print matrix of dots on the adjacently positioned paper as the printhead is scanned across the media. A given nozzle of the printhead is used to address a given matrix column print position on the paper. Horizontal positions, matrix pixel rows, on the paper are addressed by repeatedly firing a given nozzle at matrix row print positions as the pen is scanned across the paper. Thus, a single sweep scan of the printhead across the paper can print a swath of dots. The paper is advanced incrementally relative to the inkjet printheads to permit a series of contiguous swaths.

Inkjet printer 10 is shown as a full color inkjet system and therefore includes inks for the subtractive primary colors, cyan, yellow, magenta (CYM) and a true black (K). By way of example, print cartridge 20 contains cyan ink, print cartridge 22 yellow ink, print cartridge 24 magenta ink, and print cartridge 26 black ink. Different or additional colorants, such as, for example, lighter or darker shades of magenta and/or cyan, may of course be used. While the illustrated color print cartridges 20, 22, and 24 each use a dye-based ink, other types of inks may also be used, such as paraffin-based inks, as well as hybrid or composite inks having both dye and pigment characteristics.

Carriage 16 and thus print cartridges 20, 22, 24 and 26 are mounted on shaft 18 for shuttle-type reciprocating movement over media 12. Shaft 18 and carriage 16 are mounted on printer chassis 19. A carriage motor 21, typically a servo motor that is connected via circuitry 25 to controller 90 and to carriage 16 with a drive belt 27 (illustrated schematically), moves or "scans" carriage 16 during printing in a back and forth direction transverse to the direction of media advancement through the printzone 14. It is common in the art to refer to the scanning direction as the x-axis, the paper feed direction through the printzone as the y-axis, and the ink drop firing direction as the z-axis. That convention is used herein.

As noted, carriage 16 is under the control of the printer controller 90. The position of carriage 16 relative to paper 12 in the direction along the x-axis is determined by way of an encoder strip 23 that has its opposite ends mounted to the printer chassis 19. The encoder strip 23 extends past and in close proximity to an encoder or optical sensor (not shown) carried on carriage 16 to thereby signal to the printer controller 90 the position of the carriage assembly 16 relative to the encoder strip 23.

The paper 12 is incrementally advanced through the printzone 14 by a paper transport mechanism (not shown), typically in-between scans of the carriage 16. An encoder, typically a disk encoder, and associated servo systems are one of the methods often employed for controlling the precise incremental advance of the media. This incremental advance is commonly called "linefeed." Precise control of the amount of the advance, the linefeed distance, contributes to high print quality. The paper advance mechanisms must move the paper 12 through the printzone 14 the desired distance with each incremental advance, at the desired rate, and so that the paper is oriented correctly relative to the printheads 28.

Each illustrated print cartridge 20, 22, 24 and 26 is individually coupled to a respective ink supply main reservoir 30, 32, 34 and 36, by separate flexible ink delivery tube or other conduit 40, 42, 44 and 46, respectively, in what is known as an "off axis" ink delivery system. An off axis system may be contrasted with a replaceable, self-contained ink delivery system where each print cartridge has a reservoir that carries the entire ink supply as it reciprocates along the x-axis, and is thus called an "on axis" delivery system. Each pen 20 through 26 includes an on-board reservoir or chamber for holding a volume of ink that is typically smaller than the volume of ink contained in the main reservoirs 30 through 36. The main reservoirs 30 through 36 are typically replaceable ink-in-foam or spring-in-bag designs, but other reservoir designs may also be used.

A service station shown generally and schematically in dashed lines at 50 services the printheads 28 associated with each of the pens 20, 22, 24 and 26. Service station 50 includes a pen wiper station 52 and printhead seal members 60, 62, 64 and 66. As detailed below, printhead seal members 60 through 66 are components of the ink supply main reservoirs 30 through 36. Wiper station 52 is positioned relative to pens 20 through 26 such that when the printer controller 90 causes carriage 16 to move along the x-axis in the direction of arrow A in FIG. 1, the printheads are dragged across wiper blades 58 (three of which are illustrated) to effect cleaning of the printheads 28. The wiper blades 58 physically scrape ink and contaminants off the printheads 28. Wiper station 52 may be either stationary, or may be configured to move into an out of an operative position, typically by movement with an actuating mechanism in the direction along either the z or y-axes.

The ink supply main reservoirs 30, 32, 34 and 36 may be used as components of the service station 50. That is, the main supply reservoirs 30 through 36 may be used to receive ink directly from the printheads 28 of the print cartridges 20 through 24, recycle ink spit during servicing, and cap the printheads 28 during storage, in addition to supplying ink to the printheads 28. It will be appreciated that because the main ink supply reservoirs 30 through 36 are located in the illustrated embodiment below the pens 20 through 26, it may be necessary in some circumstances to include an optional pump and appropriate valves and/or sensors, illustrated generally with reference number 41, to assist with delivery of ink through conduits 40 through 46 from ink supply main reservoirs 30 through 36 to the associated pens 20 through 26. Conduits 40 through 46 are typically flexible tubing.

As may be seen in FIG. 2, and as will be detailed below, when pens 20 through 26 are being serviced and/or stored, the pens are brought into contact with a printhead seal members 60 through 66, respectively. An actuating system 33, which is shown schematically but understood to include driving means such as a motor and appropriate linkages, is provided to move ink supply main reservoirs 30 through 36 into and out of coupling engagement with printheads 28, in the directions indicated with arrows B in the figures.

Figure 3:
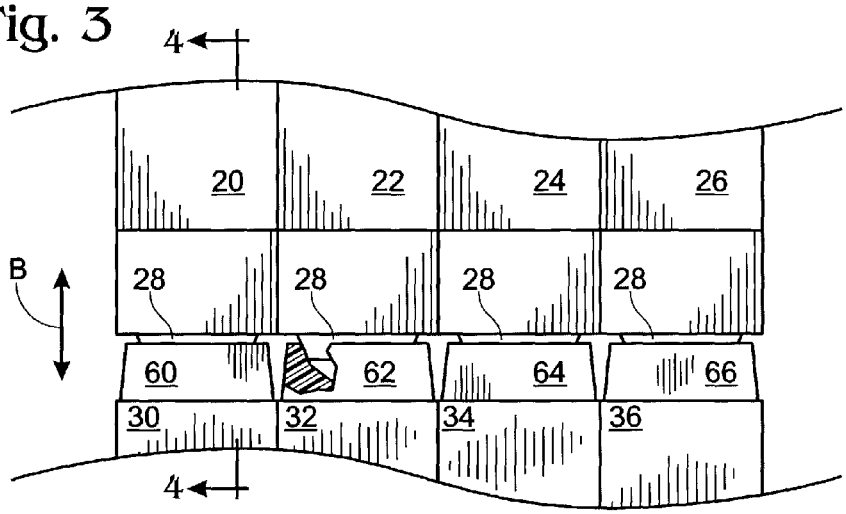
FIG. 3 is a partial fragmentary view of the inkjet pens parked in the service station according to an embodiment of the present invention taken at the close up circle 3 in FIG. 2.

With reference now to FIG. 3, each ink supply main reservoir 30 through 36 includes a printhead seal member 60, 62, 64 and 66, respectively, on the upper surface of the reservoir ("upper surface" referring to the surface of the reservoir facing print cartridges 20 through 26). Thus, printhead seal member 60 is associated with main reservoir 30; printhead seal member 62 is associated with main reservoir 62, and so on. The printhead seal members 60 through 66 are elastomeric capping members—typically fabricated of nitrile rubbers, elastomeric silicones, ethylene polypropylene diene monomer (EPDM) and equivalent compounds—that are configured to engage a respective one of the printheads 28 on the print cartridges 20 through 26 to provide a fluid seal with the printheads, and to provide a desirably humid storage environment for maintaining printhead integrity, and as detailed below, for facilitating recycling of ink spit from the printheads 28.

Figure 4:
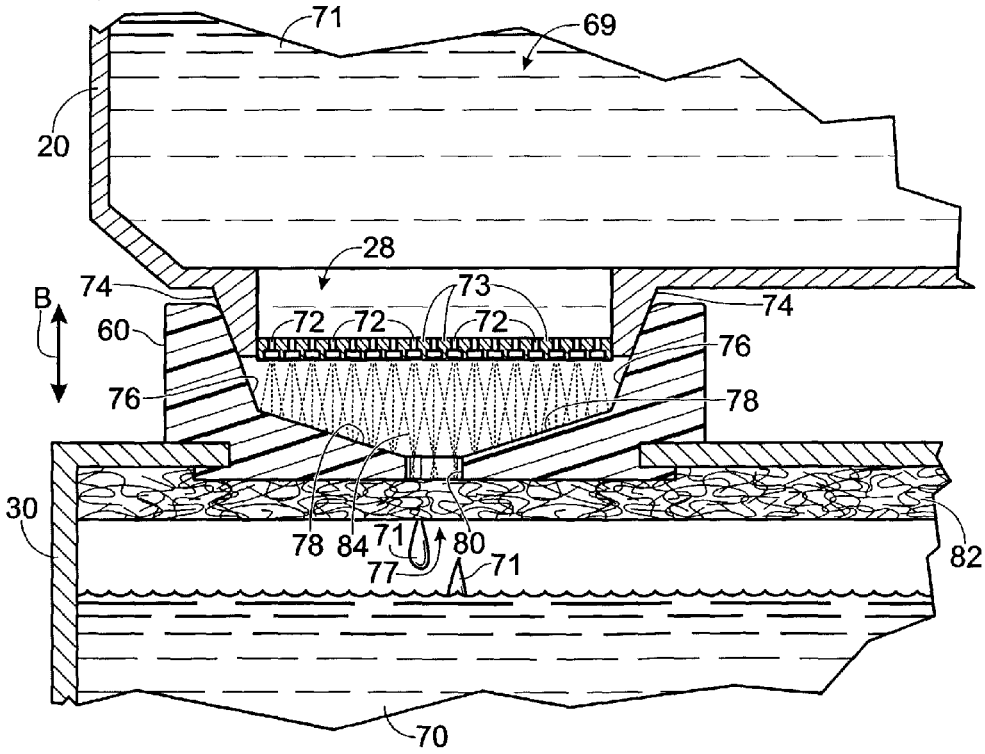
FIG. 4 is a sectional view of a single inkjet pen as it is parked in the service station according to an embodiment of the present invention taken along the line 4—4 of FIG. 3.

A single print cartridge, ink supply reservoir and printhead seal are illustrated in FIG. 4, in this case, pen 20 and the components associated therewith. Print cartridge 20 is schematically illustrated as defining a hollow ink-holding reservoir, internal chamber 69, for holding a supply of ink 71 that may be expelled through printhead 28. Printhead 28 is illustrated schematically for the sake of simplicity, and is understood to be under the control of controller 90. Printhead 28 generally includes a plurality of drop generators 73, typically thin film resistors that cause ink to be expelled in a controlled manner through corresponding ink drop firing nozzles 72. The outer wall of print cartridge 20 defines an outer peripheral wall 74 that borders and surrounds printhead 28. The outer surfaces of peripheral wall 74 are configured to form a seal with complementary wall surfaces of printhead seal member 60. One such arrangement is shown in FIG. 4 where the outer mating surfaces of peripheral wall 74 slope or taper inwardly, and the corresponding mating walls 76 of the printhead seal member 60 slope or taper correspondingly and in a complementary manner so that the respective walls 74, 76 mate to one another and form a seal therebetween.

Referring specifically to FIG. 4, printhead seal member 60 is located atop ink supply reservoir 30 and defines a capping member having interior wall surfaces that are cooperatively configured and shaped to engage the corresponding outer peripheral wall 74 of print cartridge 20. Thus, the inward-facing surfaces of member 60 define a first downwardly sloping wall section 76 that tapers inwardly and which is configured at an angle that is complimentary to the taper of outer peripheral wall 74 of print cartridge 20 such that when the supply reservoir 30 is moved into the position where seal member 60 engages print cartridge 20, as shown in FIG. 4, a fluid-tight seal is formed between the print cartridge 20 and the printhead seal member 60. Printhead seal member 60 includes a second downwardly sloping wall section 78 interiorly of wall section 76. Thus, with reference to the direction in FIG. 4 moving from first downwardly sloping wall section 76 toward the center portion of the seal member 60, the second downwardly sloping wall section 78 terminates at an opening 80 that communicates through the seal member 60 into supply reservoir 30 to define a fluid path 77 from print cartridge 20 to ink 70 held in reservoir 30. A filter 82 is positioned within reservoir 30 in the fluid path. The printer controller 90 and actuator 33 cooperate to move reservoir 30 in the direction indicated by arrows B in order to move the reservoir 30 into a sealing relationship between the printhead seal member 60 and the printhead 28 as shown.

When the printer controller 90 determines that a printhead 28 needs to spit to maintain the health of nozzles 72, or for some other reason servicing is required, the controller 90 causes carriage 16 to be positioned relative to the ink supply reservoirs 30 through 36 such that the printheads 28 are aligned over the corresponding printhead seal members 60, 62, 64 and 66. When the print cartridges 20 through 26 and their associated printheads 28 and the associated printhead seal members 60 through 66 are aligned, controller 90 causes carriage motion to stop, and the controller 90 and actuator 33 cooperate to move reservoirs 30 through 36 upwardly as indicated with arrow B in FIG. 4 until each of the printhead seal members 60 through 66 are in the position shown in FIG. 4. In this position a fluid-tight seal is formed between each of the print cartridges 20 through 26 and the associated printhead seal members 60 through 66. It should be noted that while in most instances the physical engagement between the printhead seal members 60 through 66 and the corresponding printheads 28 provides a fluid tight sealed engagement therebetween, spitting may be accomplished with the printheads 28 and printhead seal members 60 through 66 in close proximity to one another rather than in a sealed relationship. The controller 90 then causes ink to be spit by the selected printhead nozzles 72 into printhead seal member 60.

Ink 71 spit from printhead 28 is illustrated schematically in FIG. 4 with dotted lines 84. The first and second downwardly sloping walls 76 and 78 of the printhead seal member 60 cause the ink 71 to flow into opening 80, through fluid path 77, through a filter 82 and into the supply of ink 70 contained in main reservoir 30. Any contaminants carried by the ink 70 or introduced from other sources are captured by the filter 82 and are therefore prevented from entering the supply of ink 70 or delivery conduit 40. Spit ink 71 from pen 20 is thus mixed with ink 70 residing in the supply reservoir 30 and is recycled since it is again available to be drawn into delivery conduit 40 and reintroduced into chamber 69 of print cartridges 20. The controller 90 is configured for initiating spitting for any of the printheads on an individual basis, or for all of the printheads together. During the periods of time when the pens are separated from the printhead seal members, as for example during active printing operations, filter 82 serves as a plug or seal that retards any evaporation of ink 70 from the supply reservoir 30.

By recycling the ink in the manner just described, overall consumer ink costs are reduced and the printer need not be taken out of service to eliminate waste ink in a spittoon. Moreover, the mess associated with waste ink in spittoons, and possible environmental consequences of throwing out waste ink, are eliminated. And by eliminating the hardware associated with spittoons and the associated mechanisms, valuable space in the printer housing are freed up for other components, or for reduction in the size and cost of the printer. Finally, since the print cartridges 20 through 26 are brought into a sealing engagement with the printhead seal members 60 through 66 when spitting occurs, any ink aerosolized during spitting is recycled, eliminating the risk that ink thus expelled from one printhead 28 may cross contaminate adjacent printheads 28.

After spitting as described above, the print cartridges 20 may return to printing, undergo other servicing, or be capped for storage. It will be appreciated that in the case where the print cartridges 20 through 26 are to be stored after spitting, then the sealing engagement described above between print cartridges 20 through 26 and printhead seal members 60 through 66 is maintained. When the print cartridges 20 through 26 and their associated printheads 28 are to be stored between periods of printing, the carriage 16 and print cartridges 20 through 26 are positioned over the ink supply reservoirs 30 through 36 as shown in FIG. 1. Controller 90 in cooperation with actuator 33 moves supply reservoirs 30 through 36 upwardly (in the direction of the z-axis indicated with arrows B) so that the printhead seal members 60 through 66 are brought into contact with the print cartridges 20 through 26 as previously described. The sealing engagement between the print cartridges 20 through 26 and the associated printhead seal members 60, 62, 64 and 66 creates a controlled environment around the printhead nozzles that helps maintain printhead health. Specifically, when the print cartridges 20 through 26 are in a sealing engagement with the seal members 60 through 66, which communicate via openings 80 and fluid paths 77 with a large reservoir of ink 70 contained in the main reservoirs 30 through 36, as shown and described, the ambient pressure and humidity conditions surrounding the printhead 28 during storage are favorable and promote long printhead life. Thus, the humidity is controlled around the printheads 28 not only by the ink present in the nozzles 72, but also by the fluid communication with the relatively large reservoir of supply ink 70. The desirable humid environment thus created and maintained helps to reduce ink thickening at the nozzles. Finally, during storage, ink is often and inevitably drooled from a printhead 28. When the printheads 28 are capped as described above with printhead seal members 60 through 66, drooled ink flows back into the ink supply reservoirs through openings 80 where it is recycled in the same manner as ink that is intentionally spit from the nozzles 72.

Figure 5:
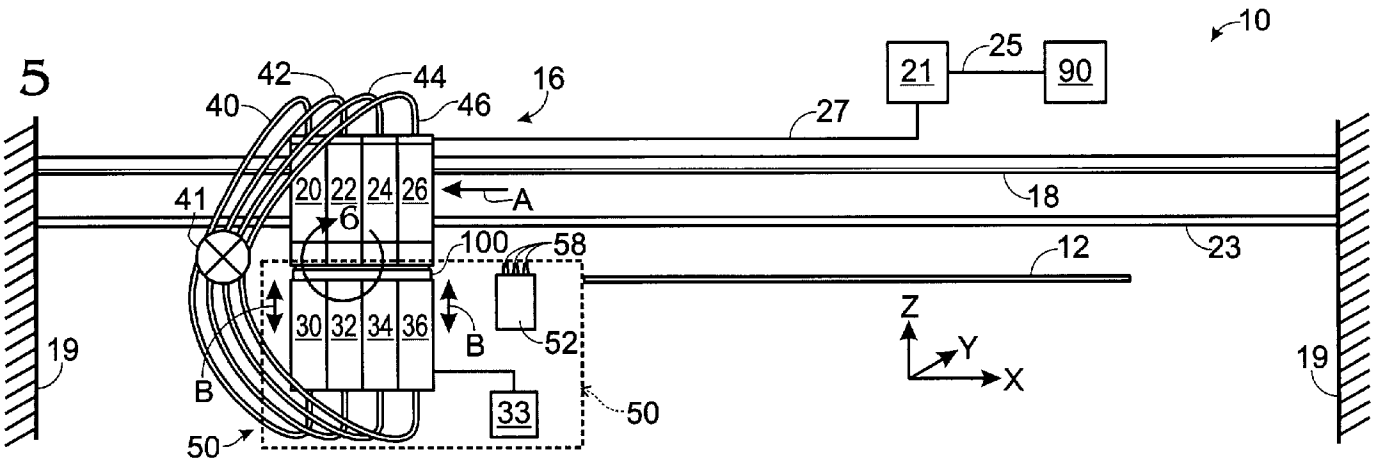
FIG. 5 is a schematic front view of an inkjet printer similar to the printer shown in FIG. 1, illustrating an alternate embodiment of the present invention in which the printhead seal member is fabricated in a single piece.
Figure 6:
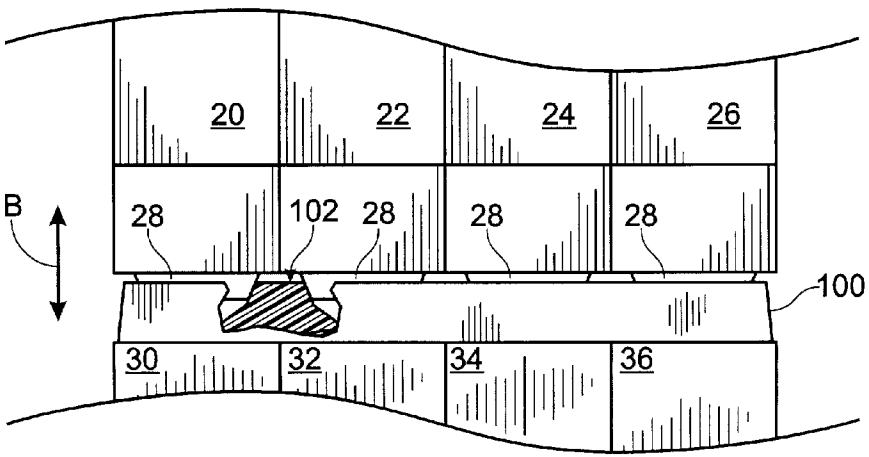
FIG. 6 is a partial fragmentary view of the inkjet pens shown in FIG. 5 parked in the service station according to the embodiment, taken at the close up circle 6 of FIG. 5.

In the embodiment illustrated in FIGS. 1 through 4, each ink supply reservoir 30 through 36 includes a separate printhead seal member, 60 through 66, which seals over a separate printhead 28 on an associated pen 20 through 26. It will be appreciated that the printhead seal members may be fabricated in a single piece. An alternate embodiment of the invention showing a single piece printhead seal member is illustrated in FIGS. 5 and 6. With reference to those drawings, the individual printhead seal members 60 through 66 have been replaced with a single printhead seal member 100 that is fabricated to fit atop each of the four ink supply main reservoirs 30 through 36. Apart from being fabricated in a single piece that engages all of the ink supply main reservoirs, printhead seal member 100 is substantially the same as the individual printhead seal members 30 through 36 as detailed above. As shown in the partial fragmentary view of FIG. 6, printhead seal member 100 defines four capping members, one for each of the printheads 28 associated with pens 20 through 26. Because the seal member 100 is fabricated in a single piece, a partition 102 is provided between adjacent pens, such as the partition 102 between pens 20 and 22 shown in FIG. 6. Partition 102 is fabricated as an integral part of seal member 100.

It will be appreciated that single-piece printhead seal member 100 may be used in a printer that utilizes more or less pens than the four illustrated herein.

The ink supply reservoirs 30 through 36 are replaceable. The printhead seal members may be fabricated such that they are replaced when the ink supply reservoirs are replaced, or the seal members may be reused on the replacement reservoirs if desired. The printhead seal members may thus be made as replaceable consumable components, as reusable components, or as permanent components or any combination.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

The invention claimed is:

1. A method for maintaining a printhead, comprising the steps:

(a) supplying ink to a printhead from an ink supply reservoir;

(b) positioning the printhead adjacent the ink supply reservoir such that the printhead is aligned with the ink supply reservoir; and (c) spitting ink from the printhead into the ink supply reservoir.

2. The method of claim 1 wherein the printhead is disposed in a print cartridge, the method including the step of establishing a sealing engagement between the printhead and the ink supply reservoir.

3. The method of claim 2 including the step of filtering contaminants from ink spit from the printhead into the ink supply reservoir.

4. The method of claim 3 wherein the step of filtering contaminants comprises positioning a filter between the printhead and the ink supply reservoir.

5. The method of claim 1 including the steps of (a) supplying ink to plural printheads from a separate ink supply reservoir associated with each printhead;

(b) positioning each printhead adjacent a respective one of the separate ink supply reservoirs such that each printhead is aligned with the respective separate printhead; and (c) spitting ink from selected ones of the printheads into the respective one of the separate ink supply reservoirs.

6. The method of claim 1 including the step of scraping ink from the printhead with a wiper blade.

7. A system for receiving and recycling ink, comprising:

a print cartridge having a printhead;

an ink supply reservoir;

a fluid conduit interconnecting the ink supply reservoir to the print cartridge;

a seal member mounted on the ink supply reservoir and defining a fluid path into the reservoir, the print cartridge configured for engaging the seal member so that ink spit from the printhead flows through the fluid path into the reservoir.

8. The system or claim 7 wherein the seal member further comprises an elastomeric cap defining walls configured for engaging cooperatively formed walls on the printhead, and the seal member further defines the fluid path into the reservoir.

9. The system of claim 7 including a filter in the fluid path.

10. The system of claim 9 wherein the filter is interposed in the fluid path between the seal member and the ink supply reservoir.

11. The system of claim 10 wherein the filter further defines a plug for preventing loss of ink from the ink supply reservoir through the fluid path.

12. The system of claim 7 including a wiper blade positioned for scraping ink from the printhead.

13. The system of claim 7 including a pump in the fluid conduit operable to pump ink contained in the ink supply reservoir to the print cartridge.

14. The system of claim 7 including an actuator coupled to the ink supply reservoir and configured for selectively moving the ink supply reservoir into and out of a fluidly sealed engagement with the print cartridge.

15. The system of claim 14 wherein the actuator further comprises a driving means for selectively moving the ink supply reservoir into and out of the fluidly sealed engagement with the print cartridge.

16. A system for receiving and recycling ink, comprising:

plural print cartridges, each print cartridge in the plurality having a printhead associated therewith;

plural ink supply reservoirs, each ink supply reservoir in the plurality associated with a print cartridge;

plural fluid conduits, each conduit in the plurality interconnecting an ink supply reservoir with the associated print cartridge;

plural seal members, each seal member in the plurality coupled to an associated ink supply reservoir and each seal member defining a fluid path into the associated reservoir, wherein each print cartridge in the plurality is configured for engaging an associated seal member so that ink spit from the printhead flows through the fluid path into the reservoir.

17. The system of claim 16 wherein each of the plural seal members further comprises an elastomeric cap defining walls configured for engaging cooperatively formed walls on the associated printhead, and each of the plural seal members further defines the fluid path into the associated reservoir.

18. The system of claim 17 wherein the plural seal members further comprise a one piece elastomeric cap.

19. A method of maintaining a printhead, comprising the steps of:

(a) supplying ink to a printhead from an ink supply reservoir, wherein the ink supply reservoir defines a capping member having a fluid pathway therethrough to the supply of ink;

(b) moving a print cartridge housing the printhead into a sealing engagement with the capping member so that the printhead is in fluid communication with the supply of ink.

20. The method of claim 19 including the step of causing the printhead to expel ink while the print cartridge is in the sealing engagement with the capping member so that the ink expelled from the printhead flows into the ink supply reservoir.

21. The method of claim 20 including the step of removing contaminants from the ink expelled from the printhead.

22. The method of claim 21 wherein contaminants are removed from the ink expelled from the printhead with a filter in the fluid pathway.

23. A maintenance system for capping a printhead, comprising:

a print cartridge having the printhead;

an ink supply reservoir coupled to the print cartridge with a conduit;

a printhead cap on the ink supply reservoir, the printhead cap defining a fluid path into the ink supply reservoir and defining a seat configured to receive the print cartridge and to define a seal between the print cartridge and the printhead cap.

24. The maintenance system of claim 23 wherein ink expelled from the printhead flows through fluid path and into the ink supply reservoir.

25. The maintenance system of claim 24 wherein the ink expelled from the printhead is reintroduced to the printhead through the conduit.

26. The maintenance system of claim 25 including a filter interposed in the fluid pathway.

27. The maintenance system of claim 23 including a wiping blade for scraping ink from the printhead.

28. A system for receiving and recycling ink, comprising:

a print cartridge having a printhead;

an ink supply reservoir;

a fluid conduit interconnecting the ink supply reservoir to the print cartridge;

seal member means mounted on the ink supply reservoir and defining a fluid path into the reservoir, the print cartridge configured for engaging the seal member means so that ink spit from the printhead flows through the fluid path into the reservoir.

29. The system of claim 28 wherein the seal member means further comprises flexible cap means defining walls configured for engaging cooperatively formed walls on the printhead.

30. The system of claim 29 wherein the seal member means further comprises fluid path means into the reservoir.

31. The system of claim 30 further comprising filter means in the fluid path means.

32. The system of claim 28 including pump means in the fluid conduit for pumping ink contained in the ink supply reservoir to the print cartridge.

33. The system of claim 28 including actuator means coupled to the ink supply reservoir for selectively moving the ink supply reservoir into and out of a fluidly sealed engagement with the print cartridge.

34. The system of claim 33 wherein the actuator means further comprises driving means for selectively moving the ink supply reservoir into and out of the fluidly sealed engagement with the print cartridge.

* * * * *

UNITED STATES PATENT AND TRADEMARK OFFICE

CERTIFICATE OF CORRECTION

PATENT NO. : 7,048,353 B2
APPLICATION NO. : 10/278545
DATED : May 23, 2006
INVENTOR(S) : David J. Waller et al.

It is certified that error appears in the above-identified patent and that said Letters Patent is hereby corrected as shown below:

In column 7, line 66, in Claim 8, delete “or” and insert -- of --, therefor.

In column 9, line 8, in Claim 23, delete “seat” and insert -- seal --, therefor.

Signed and Sealed this

Sixteenth Day of June, 2009

John Doll

JOHN DOLL
*Acting Director of the United States Patent and Trademark Office*